US006112895A

United States Patent [19]

Ryan

[11] Patent Number: 6,112,895

[45] Date of Patent: Sep. 5, 2000

[54] GOLF CLUB BAG SECURITY DEVICE

[76] Inventor: Dennis Ryan, 2413 Industrial Dr., Springfield, Tenn. 37172

[21] Appl. No.: 09/213,518

[22] Filed: Dec. 17, 1998

[51] Int. Cl.[7] ..... A63B 55/00

[52] U.S. Cl. ..... 206/315.6; 206/315.2; 206/315.3; 70/58

[58] Field of Search ..... 206/315.2–315.4, 206/315.6; 211/70.2; 70/58

[56] References Cited

U.S. PATENT DOCUMENTS

| | | | |
|---|---|---|---|
| 1,599,170 | 9/1926 | Fatjo | 206/315.6 |
| 1,835,632 | 12/1931 | Buhrke | 211/70.2 |
| 1,988,870 | 1/1935 | Hotze | 206/315.3 |
| 4,020,661 | 5/1977 | Rich | 70/58 X |
| 4,863,019 | 9/1989 | Lewis et al. | 206/315.3 |
| 5,004,100 | 4/1991 | Smith | 206/315.2 |
| 5,520,291 | 5/1996 | Graham | 70/58 X |
| 5,524,753 | 6/1996 | Murphy | 206/315.6 |
| 5,582,043 | 12/1996 | McCue et al. | 70/58 |
| 5,590,772 | 1/1997 | Schuhlen et al. | 206/315.3 |
| 5,610,585 | 3/1997 | Jobe | 340/568 |
| 5,829,604 | 11/1998 | Brophy | 211/70.2 |
| 5,862,909 | 1/1999 | Jacobsen | 206/315.3 |
| 5,904,247 | 1/1999 | Voelkner, Jr. | 206/315.4 |
| 5,971,146 | 10/1999 | Jones | 206/315.3 |

*Primary Examiner*—Sue A. Weaver
*Attorney, Agent, or Firm*—Luedeka, Neely & Graham, P.C.

[57] ABSTRACT

A locking golf club bag apparatus is provided for locking a plurality of golf clubs in the bag. The bag has an open mouth and at least one divider spanning the mouth and dividing the mouth into a plurality of compartments. A locking bar is slideable relative to the bag in a direction parallel to the divider. When the locking bar is in its locked position, it is transversely spaced from the divider by a distance greater than a smaller diameter portion of the shaft of the golf club, and less than a larger diameter portion of the handle of the golf club so that the golf club is locked between the locking bar and the divider.

11 Claims, 3 Drawing Sheets

GOLF CLUB BAG SECURITY DEVICE

BACKGROUND OF THE INVENTION

1. Field of the Invention

The present invention relates generally to apparatus for securely locking golf clubs in a bag.

2. Description of the Prior Art

There have been several previous attempts to provide a practical security apparatus for a golf bag.

U.S. Pat. No. 5,524,753 to Murphy discloses a golf club bag security device which includes three plates fitted over the mouth of the bag. A plurality of slots are defined in the plate for receiving the clubs. The central most plate slides relative to the other two plates in a direction perpendicular to the length of the slots to clamp the golf clubs in place within the bag.

U.S. Pat. No. 5,004,100 to Smith discloses a security device having a plate which fits over the mouth of the bag. The plate has several slots defined therein. One end portion of the plate is hinged and removable to allow the golf clubs to slide out the end of the slots to be removed.

U.S. Pat. No. 5,590,772 to Schuhlen, et al., discloses a locking apparatus including a plurality of U-shaped bars which define channels therebetween for trapping the golf club handle. The U-shaped bars are received in a locking device.

U.S. Pat. No. 4,863,019 to Lewis, et al., discloses a security device which includes a pair of elongated rigid arm members for gripping the golf club shafts therebetween.

U.S. Pat. No. 5,582,043 to McCue, et al., discloses a gold club security device including a closed bag which fits over the mouth of the golf club bag.

U.S. Pat. No. 5,610,585 to Jobe discloses an electronic shock sensitive security device.

Thus, while the prior art has shown several solutions to the problem of securing golf clubs in a bag against theft, there is still the need for a simple, inexpensive and practical security apparatus.

SUMMARY OF THE INVENTION

A locking golf club bag apparatus is provided for locking a plurality of golf clubs in the bag. The golf club bag has an open mouth and at least one divider spanning the mouth and dividing the mouth into a plurality of compartments. At least one locking bar is slideably engageable with the bag. The bar slides in a direction parallel to the divider. The bar slides between an unlocked position and a locked position. In the locked position, the locking bar is transversely spaced from the divider by a distance greater than a smaller diameter portion of the golf club shafts and less than a larger diameter portion of the handle of the shafts, so that the golf clubs are locked between the locking bar and the divider.

In a preferred embodiment, the golf club bag has several such dividers, and the locking bar is one of several locking bars that are formed together on a locking fork. All of the golf clubs may be simultaneously locked in the bag by leaning the bag so that the golf club shafts rest against the dividers, and then sliding the locking fork in place within the bag.

In another embodiment, a retractable locking cable is attached to the bag adjacent the mouth thereof. The locking cable may be utilized in conjunction with the locking fork to lock the locking fork in place within the bag.

Methods of using such an apparatus are also provided.

It is therefore an object of the present invention to provide an improved golf club bag security device.

Another object of the present invention is the provision of a golf club bag security device which can be economically manufactured.

Still another object of the present invention is the provision of a golf club bag security device which is very easy to use, and which does not get in the way when not in use.

Numerous other objects features and advantages of the present invention will be readily apparent to those skilled in the art upon the reading of the following disclosure when taken in conjunction with the accompanying drawings.

DETAILED DESCRIPTION OF THE PREFERRED EMBODIMENTS

Figure 1:
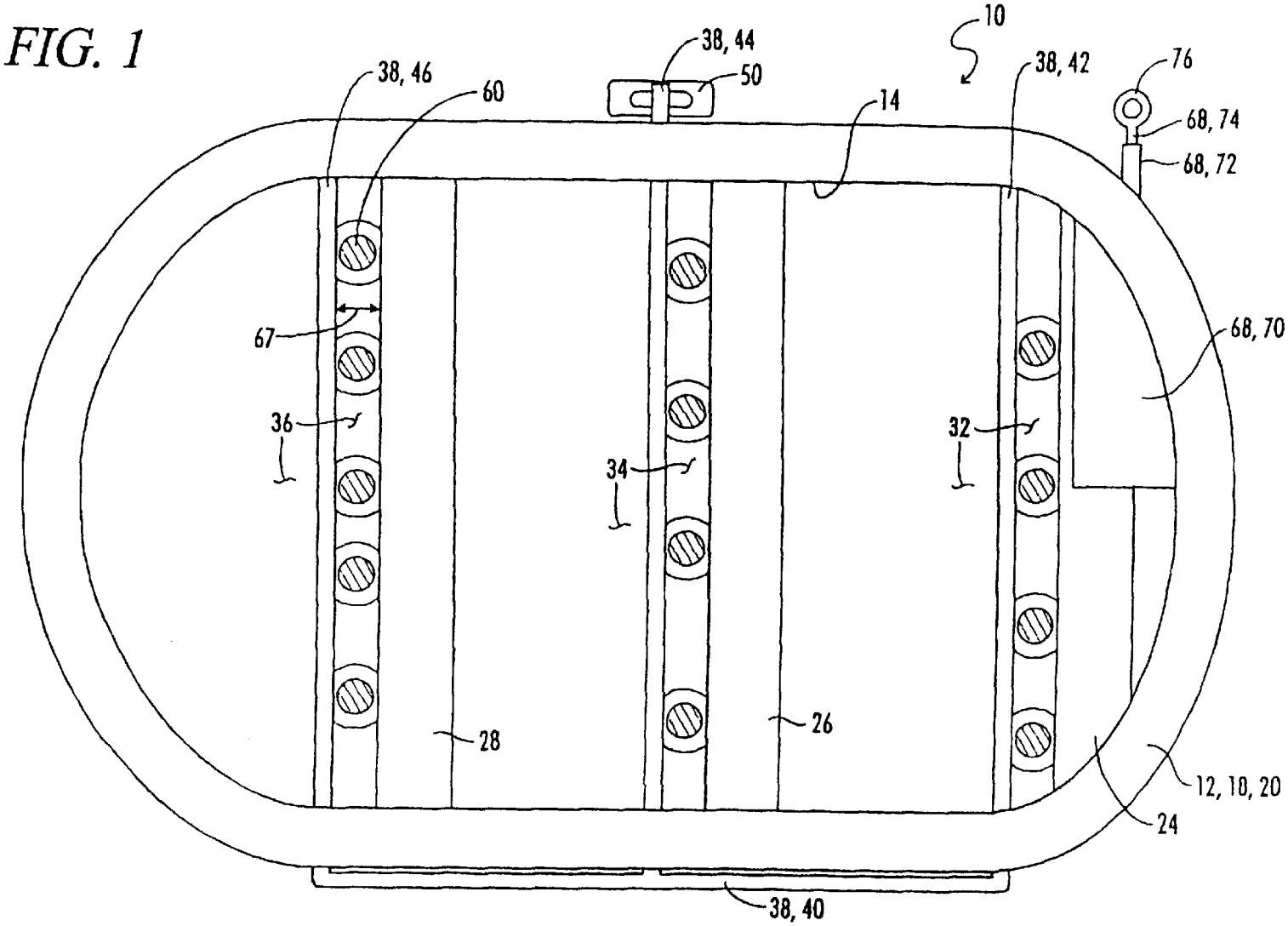
FIG 1 is a plan view of the mouth of the open top end of the golf bag. The security device is locked in place in the view of FIG. 1.
Figure 2:
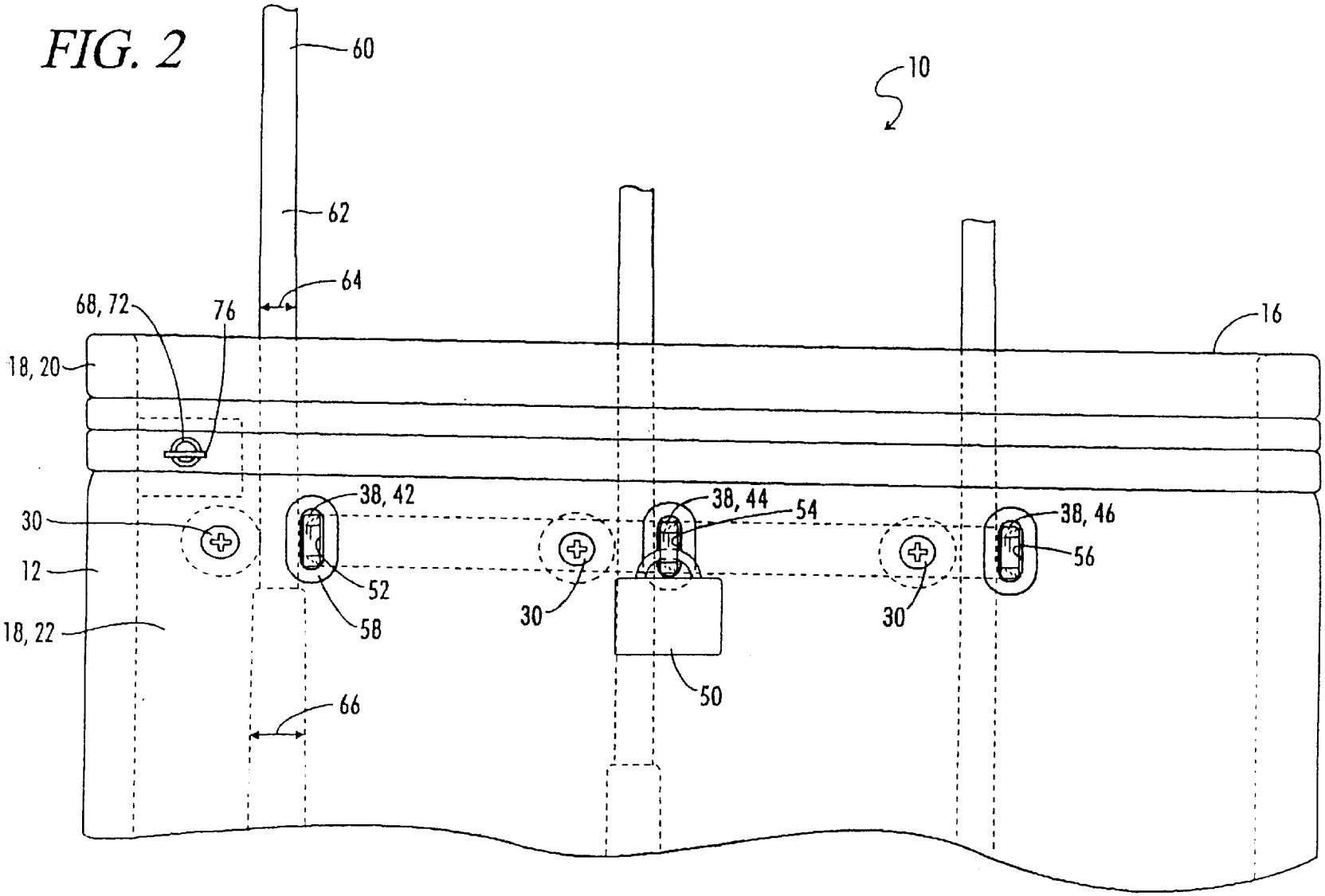
FIG. 2 is an elevation view of the apparatus of FIG. 1, taken along the top side of the plan view of FIG. 1.

Referring now to the drawings, and particularly to FIGS. 1 and 2, a locking golf club bag apparatus is shown and generally designated by the numeral 10. The apparatus 10 includes a bag 12 having an open mouth 14 at its upper end 16. It will be appreciated that only the upper portion of the bag 12 is illustrated in the elevation view of FIG. 2.

The bag 12 can be described as having a continuous side wall 18 which circumscribes the mouth 14. The side wall 18 typically includes a relatively rigid reinforced collar 20 immediately adjacent the mouth, and a relatively more flexible main bag portion 22 extending downward from the collar 20. The bag may be constructed from leather, nylon, or any number of other materials as is well known in the art.

First, second and third dividers, 24, 26 and 28, are fixedly mounted within the collar 20 by fasteners such as 30. The dividers 24, 26 and 28 are straight and are oriented parallel to each other and span the mouth 14 to divide the mouth 14 into three compartments 32, 34 and 36. The dividers 24, 26 and 28 are preferably constructed from aluminum, steel or a hard plastic material and are preferably covered with a soft material to protect the finish of the golf clubs.

FIGS. 1 and 2 show a locking fork 38 in place in a locked position within the bag 12.

Figure 3:
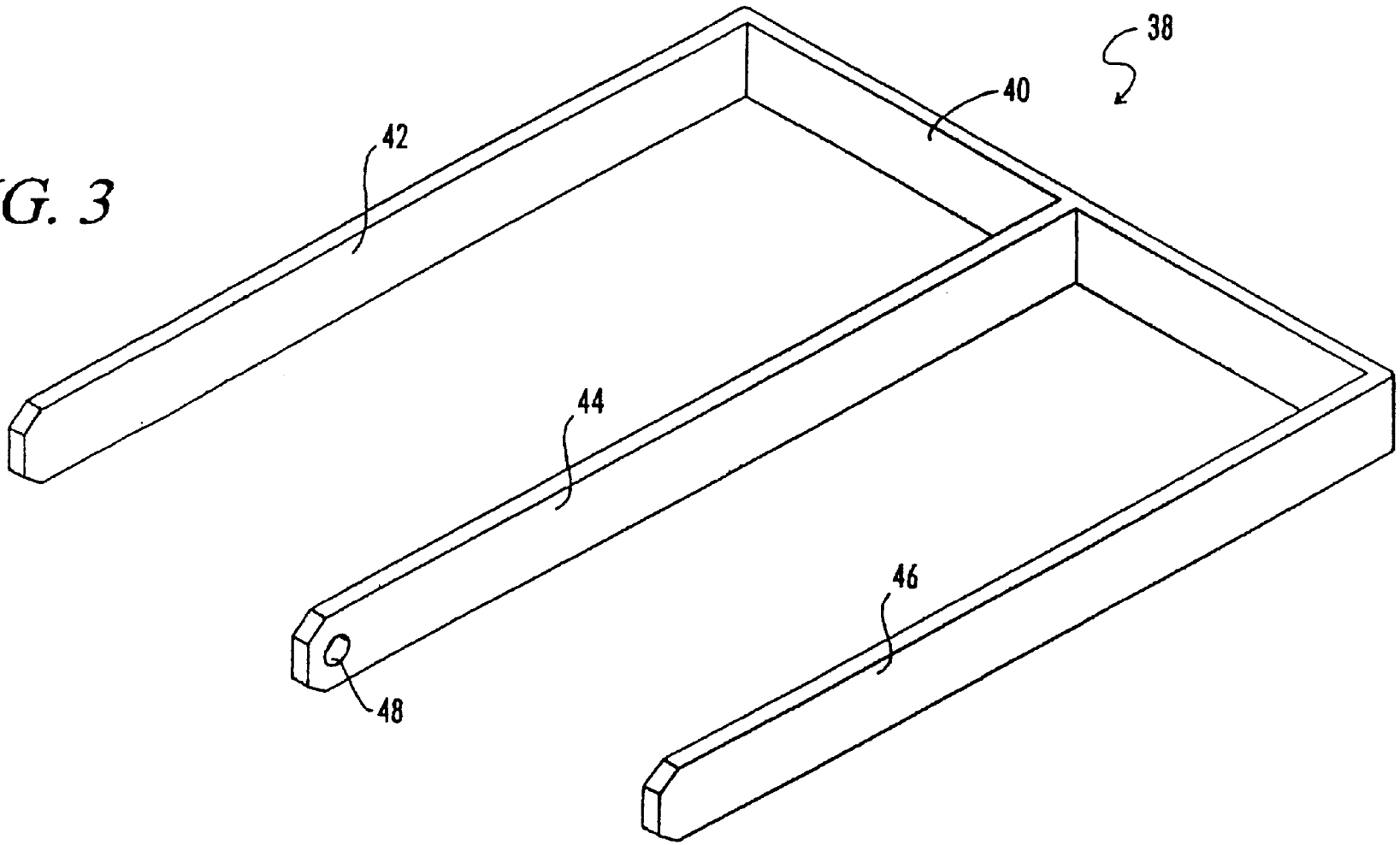
FIG. 3 is an isometric view of the locking fork removed from the golf bag.

The locking fork 38 is best shown in FIG. 3 which is an isometric view of the locking fork 38 taken alone. The locking fork 38 includes a base member 40 having first, second and third locking bars, 42, 44 and 46, extending therefrom. In the embodiment illustrated, the locking bars 42, 44 and 46 are rectangular cross section flat bars which extend parallel to each other and perpendicularly from the base 40. Alternatively, the locking bars could have a round cross-section. The second locking bar 44, which may be referred to as a center locking bar 44, is longer than the bars 42 and 46. As can be seen in FIG. 1, when the locking fork 38 is fully inserted into the bag 12, the center locking bar 44 extends all the way through the side wall 18 and extends out of the bag 12. The free outer end portion of the center locking bar 44 includes a lateral bore or padlock opening 48 which provides a means for attachment of a conventional padlock 50 thereto to lock the locking bar 38 in place relative to the bag 12.

The locking fork 38 is preferably constructed from aluminum or steel bar. It may be covered with plastic or similar material to prevent scratching of the golf clubs which are held in the bag.

As is best seen in FIG. 2, the side wall 18 includes three pairs of side wall holes such as 52, 54 and 56 through which the locking bars 42, 44 and 46, respectively, are received. The side wall holes are preferably formed with grommets such as 58 which are fastened to the material of the side wall 18.

With reference to FIG. 1, it will be apparent that the padlock 50 can be removed and the locking fork 38 can then be completely withdrawn from engagement with the bag 12. This leaves the compartments 32, 34 and 36 completely open so that golf clubs can be freely placed therein. In FIGS. 1 and 2 a plurality of golf clubs are each designated by the numeral 60. As will be understood by those skilled in the art, each of the golf clubs 60 includes a shaft 62 having a smaller cross sectional diameter 64 at its intermediate portion and having an enlarged diameter handle having a larger diameter 66 at its lower end.

The locking bars 42, 44 and 46 are located relative to their associated dividers 24, 26 and 28, respectively, so that each locking bar such as 46 is substantially parallel to its respective divider such as 28 and is spaced laterally from its respective divider by a distance 67 which is greater than the shaft diameter 60 but less than the handle diameter 66. Thus when the locking fork 38 is locked in place as shown in FIG. 1, the clubs 60 cannot be withdrawn from the bag 12.

In a preferred embodiment, the distance 67 is in a range from ⅜ inch to ⅝ inch and is preferably about ½ inch.

When the golf club bag is in use, the locking fork 38 is withdrawn from the bag and stored away in one of the storage compartments of the bag. The golf clubs may be freely placed in any of the compartments 32, 34 and 36. At such time that it is desired to lock the clubs within the bag, such as for example, when the golfer may be leaving the bag outside while going into the club house, the locking fork 38 can be easily installed in the following manner.

The golf bag is simply tilted to the left when viewed as in FIG. 2, so that the shafts 62 of each of the clubs 60 will lean against the respective ones of the dividers adjacent the compartments. Then, the bars 42, 46 and 48 of locking fork 38 are simultaneously slid into place through the respective pairs of side wall openings 52, 54 and 56. The bars simultaneously slide into position by moving in a direction parallel to the length of the dividers, until the centermost bar 44, has its outer end protruding beyond the side wall as seen in FIG. 1. Then a padlock such as 50 may engage the bar 44 external of the bag to lock the locking fork 38 in place.

The locking fork 38 can be described as sliding in a direction parallel to the dividers from a first unlocked position, where the locking fork 38 has just been inserted in the holes on the first side of the bag, to a second locked position like that of FIG. 1 where the locking fork 38 is fully inserted. When in the locked position, the base 40 of locking fork 38 abuts the side wall 18.

One additional feature which may be utilized with the apparatus just described is the retractable locking cable 68 which is best seen in the plan view of FIG. 1. The retractable locking cable 68 includes a spring loaded reel 70 mounted inside the bag. A cable sheath 72 extends through the side wall of the bag and communicates with the spring loaded reel 70. A cable 74 extends through the sheath 72 and is wound upon the spring loaded reel 70. The cable 74 includes an eyelet 76 or the like on the end thereof.

The retractable locking cable 68 is preferably mounted in the bag 12 relatively close to the mouth 14 so that if desired the cable 68 may be engaged with the free end of center locking bar 44 by placing the same through the padlock opening 48 thereof to lock the locking bar 38 in place relative to the bag 12. Of course, the cable 68 can also be used to lock the bag 12 to a tree, post or the like.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A locking golf club bag apparatus for locking a plurality of golf clubs in the bag, the golf clubs having shafts which include a smaller diameter portion and a larger diameter portion the apparatus comprising:

a golf club bag having an open mouth;

a continuous side wall circumscribing the mouth;

at least one divider spanning the mouth and having opposed first and second ends attached to the side wall;

the side wall further having a first pair of side wall holes defined therein, the first pair of side wall holes including a first hole disposed in the side wall proximate the first end of the divider and a second hole disposed in the side wall proximate the second end of the divider, the holes being transversely spaced from the ends of the divider in a common transverse direction by a distance greater than the smaller diameter portion of the shafts of the clubs and less than the larger diameter portion of the shafts of the clubs; and a first locking bar slideable relative to the bag in a direction parallel to the divider between an unlocked position and a locked position, in the locked position the locking bar penetrating the first pair of side wall holes, and spanning the mouth of the bag substantially parallel to the divider, and being transversely spaced from the divider by a distance greater than the smaller diameter portion of the shafts of the clubs and less than the larger diameter portion of the shafts of the clubs so that the clubs may be locked between the locking bar and the divider.

2. The apparatus of claim 1, wherein the locking bar has a free end which may be inserted through the first pair of side wall holes.

3. The apparatus of claim 2, wherein:

the locking bar has a length such that the free end of the locking bar extends beyond the side wall of the bag when the locking bar is in the locked position; and the apparatus further includes a means for locking the free end of the locking bar external of the side wall of the bag.

4. The apparatus of claim 2, further comprising:

a retractable locking cable attached to the bag and located so that the locking cable may be engaged with the free end of the locking bar to lock the locking bar in place relative to the bag.

5. The apparatus of claim 1, further comprising:

a locking fork having a base and a plurality of locking bars extending from the base, the plurality of locking bars including the first locking bar.

6. The apparatus of claim 5, wherein;

the plurality of locking bars includes three locking bars, one of which is a center locking bar; and the bag has a continuous side wall circumscribing the mouth, the side wall having three pairs of side wall holes defined therein on opposite sides of the mouth for receiving the three locking bars therethrough.

7. The apparatus of claim 6, wherein:

the center locking bar has a free end and has a length such that the free end of the center locking bar extends beyond the side wall of the bag when the locking bar is in the locked position; and the apparatus further includes a means for locking the free end of the center locking bar external of the side wall of the bag.

8. A golf club bag apparatus, comprising:

a continuous side wall defining an open mouth;

a plurality of parallel dividers spanning the mouth of the bag;

the side wall having a plurality of pairs of side wall holes defined therein on opposite sides of the mouth; and a locking fork having a base and a plurality of parallel locking bars extending from the base, each of the locking bars being received through a respective one of the pairs of side wall holes and being substantially parallel to a respective one of the dividers and spaced laterally from the respective one of the dividers a distance greater than a smaller diameter portion of a golf club shaft and less than a larger diameter handle of the golf club.

9. The apparatus of claim 8, wherein:

the plurality of dividers includes three dividers; and the plurality of locking arms includes three locking arms.

10. The apparatus of claim 8, wherein:

one of the locking bars has a length such that when the base of the locking fork abuts the side wall of the bag, said one of the locking bars extends through its respective side wall hole in the side of the mouth opposite from the base of the locking fork; and said one of the locking bars has a lateral bore defined therethrough and located outside the side wall of the bag so that a removable lock may be received through the lateral bore of said one of the locking bars to lock the locking fork in place relative to the bag.

11. The apparatus of claim 8, further comprising:

a retractable locking cable attached to the bag and located so that the locking cable may be engaged with one of the locking bars to lock the locking fork in place relative to the bag.

* * * * *

UNITED STATES PATENT AND TRADEMARK OFFICE

CERTIFICATE OF CORRECTION

PATENT NO. : 6,112,895
DATED : September 5, 2000
INVENTOR(S) : Ronald D. Lee

It is certified that error appears in the above-identified patent and that said Letters Patent is hereby corrected as shown below:

Title page,
Item [76] should read -- Ronald D. Lee, 4133 Hoods Branch Road, Springfield, Tenn. 37172 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*